United States Patent [19]

Dillitzer

[11] Patent Number: 4,732,201

[45] Date of Patent: Mar. 22, 1988

[54] ROLLER BLINDS

[76] Inventor: Manfred Dillitzer, Valeppweg 7, D-8038 Grobenzell, Fed. Rep. of Germany

[21] Appl. No.: 27,202

[22] PCT Filed: Jun. 12, 1986

[86] PCT No.: PCT/EP86/00351

§ 371 Date: Mar. 17, 1987

§ 102(e) Date: Mar. 17, 1987

[87] PCT Pub. No.: WO86/07407

PCT Pub. Date: Dec. 18, 1986

[30] Foreign Application Priority Data

Jun. 12, 1985 [DE] Fed. Rep. of Germany ..... 3521084

[51] Int. Cl.[4] ..... E06B 9/08

[52] U.S. Cl. ..... 160/25; 160/133

[58] Field of Search ..... 160/25, 133, 214, 238, 160/268 S, DIG. 10

[56] References Cited

U.S. PATENT DOCUMENTS

| | | | |
|---|---|---|---|
| 574,959 | 1/1897 | Still | 160/25 |
| 1,181,499 | 5/1916 | Zeman | 160/268 S |
| 2,072,726 | 3/1937 | Yartyan | 292/37 |
| 2,404,257 | 7/1946 | Thomas | 160/133 |
| 2,605,823 | 8/1952 | Lockhart | 160/30 |
| 4,151,871 | 5/1979 | Ryan | 160/25 |

FOREIGN PATENT DOCUMENTS

| | | |
|---|---|---|
| 2934122 | 3/1981 | Fed. Rep. of Germany . |
| 1321927 | 2/1963 | France . |
| 409333 | 10/1966 | Switzerland . |

*Primary Examiner*—Robert W. Gibson, Jr.

[57] ABSTRACT

In a roller blind with an armor (3) comprising lamellae (4, 4') which may be moved in guiding rails (5) at the side over a deployment length and which can be rolled on or off a take-up roll (2) disposed in a roller-blind housing (1), the free end of a material or coarse-screen blind (6), which is rolled up under the tension of a spring on a roll (7) that in turn is accommodated in a blind housing (8), is fastened to the last lamella (4') at the free end of the armor (3) and the blind housing (8) is disposed below the last lamella (4') of the armor (3). Moreover, the blind housing (8) can be moved over the deployment length (L) of the armor (3), can be locked in position at any height by means of a locking mechanism (10, 11) and, when not in the locked position, is pressed by the tension of a spring in set contact with the last lamella (4').

13 Claims, 15 Drawing Figures

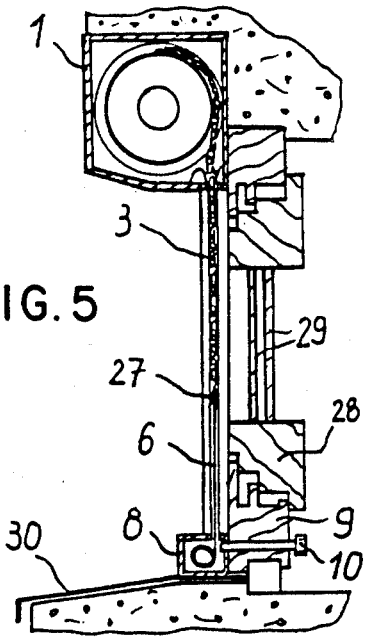
FIG. 5
FIG. 7
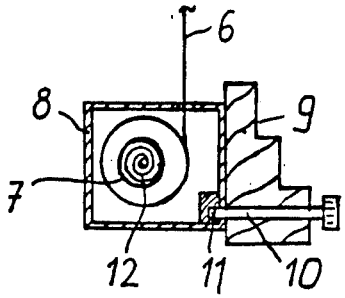
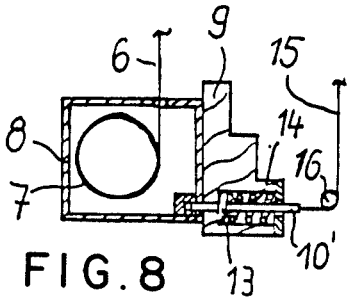
FIG. 8
FIG. 6
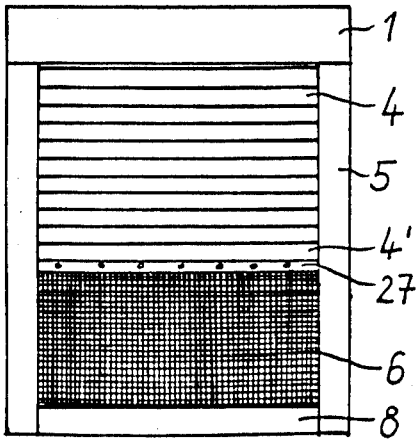
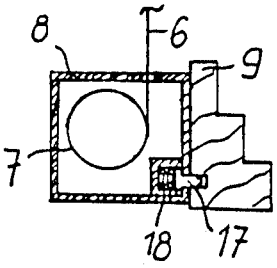
FIG. 9

ROLLER BLINDS

TECHNICAL FIELD

The invention relates to a roller blind with an armor comprising lamellae, which may be moved in guiding rails at the side over a deployment length and which can be rolled on or off a take-up roll disposed in a roller-blind housing, the free end of a material or coarse-screen blind, which is rolled up under the tension of a spring on a roll that in turn is accommodated in a blind housing, being fastened to the last lamella at the free end of the armor and the blind housing being disposed below the last lamella of the armor.

UNDERLYING STATE OF THE ART

Roller blinds are used on a large scale as such in new buildings, and as fixtures or mini-roller-blinds and enable window and door openings to be closed partly or completely. Always associated with this, however, is also a corresponding closing off of the area, over which the roller blind is let down. In particular, conventinal roller blinds are practically unsuitable for darkening the interior of the room somewhat relative to the light from the outside, or even for not closing off the area of the window or the doors, but only to prevent entry by insects and the like. The known roller blinds are thus suitable for closing off the area of a window or a door against unauthorized entry from outside, but can fulfill the other functions indicated either not at all or only quite inadequately.

In contrast to this, it is known that suitable protection against the sun, a desired darkening or also some protection against insects can be obtained by the use of material blinds, without at the same time closing off the opening of the window or the door as completely, as is the case with a roller blind. By selecting suitable dyeing, a suitable mesh width of the material or other suitable material parameters, such material blinds can effectively provide a desired dimming or darkening of a room relative to the outside or also a desired protection against insects, but, in turn, are totally unsuitable for closing off a window or a door opening in the sense of a roller blind, so that the unwanted entry from the outside is prevented. The same is true for the known coarse-screen blinds, which find use essentially as protection against insects.

If it is now desired to have, aside from a roller blind, also the possibility of effective protection against insects or sunlight, it is necessary to provide separately and in addition to the conventional roller blind an appropriate, conventional material or coarse-screen blind. Because of local space conditions, such measures frequently are not even possible, but in any case require a considerable structural effort and are moreover, if feasible, associated with not inconsiderable costs. In addition, it has proven to be somewhat complicated normally to operate such combined roller blinds/blinds.

From the German Auslegeschrift 2,934,122, a roller blind of the initially named type is already known, for which a roller-blind housing with a smaller material or coarse-screen blind is disposed below the window opening. The free end of the material or coarse-screen blind, which is rolled up under the tension of a spring in the blind housing, can be coupled by a coupling device to the last lamella of the armor. By these means, when the armor is pulled up, the material or coarse-screen blind is pulled up together with this armor from below at the window opening, so that the window opening, cleared by the armor, can be covered, for example, as protection against mosquitoes. However, with many windows it is not at all possible to mount a blind housing additionally below the window opening, because suitable space is frequently not available for this. With the known roller blinds moreover, the window area cleared by the armor can be only be covered either completely (when the blind is coupled on) or not at all (when the blind is not coupled on) by the material or coarse-screen blind; partial coverage by the material or coarse-screen blind of the window area cleared by the armor, perhaps to shade only a portion of the window area cleared by the roller blind, is impossible.

DISCLOSURE OF THE INVENTION

The invention is to provide a remedy here and to perfect a roller blind of the initially named type in such a manner, that the possibility of using a coarse-screen or material blind only for a part of the window or door area cleared by the roller blind is also attainable and retrofitting of already existing roller blinds is easily possible.

In accordance with the invention, this is achieved with a roller blind of the initially named type owing to the fact that the blind housing can be moved over the deployment length of the armor, can be locked in position at any height within the deployment length by means of a locking mechanism and, when not in the locked condition, is pressed by the tension of a spring in set contact with the last lamella of the armor, that is, is set against the last lamella. At the bottom of the armor of a conventional roller blind, the invention thus arranges a blind, which is rolled up in a small housing and is attached with its free end directly to the roller-blind armor. As a consequence of this, the blind in the rolled up state (because it is under the tension of a spring), hanging at the bottom of the roller-blind armor, namely at its last lamella and pressed against this, is moved up and down with the roller-blind armor, its blind housing representing so to speak a sort of "final lamella" of the roller blind. If the last lamella of the roller blind is now brought to a particular height, then the blind housing is brought along with it to a corresponding height. If the blind housing is then locked in this position, the free end of the coarse-screen or material blind can, by the subsequent upwards motion of the roller-blind armor, be pulled upwards as far as is desired against the action of its spring-tensioned take-up roll out of the blind housing, the position of which is now fixed; a window or door opening, which can be closed with the roller blind of the invention, can thus be partially covered, the opening below the blind housing remaining completely free and uncovered. At the same time, the whole of the window or door opening between the blind housing and the lowest lamella of the armor is covered or closed off by the coarse-screen or material blind to the extent that the roller blind is raised. The roller blind of the invention provides a surprisingly simple possibility for effectively combining the functions of a roller blind with those of a material or coarse-screen blind, the total space required for the installation moreover not being larger than that required for a conventional roller blind. Moreover, a portion of the window or door opening, cleared by the roller blind of the invention, can be kept fully open and a suitable darkening effect or protection against sunlight can be achieved only from a desired height onwards. To carry out this locking function, it is of coarse possible to provide in the overall construction of the roller blind special locking mechanisms, such as locking bolts, which are suitably disposed and distributed over the height. It is, however, of particular advantage if the blind housing can be fixed in position at any height by means of one and the same locking mechanism.

A further, preferred refinement of the roller blind of the invention also consists therein that the blind housing as well as the lamella of the armor are guided in the lateral guiding rails. By these means, the use of special guiding facilities for the blind housing is avoided and the possibilities of using the already existing lateral guide strips are utilized in an advantageous manner.

Pursuant to the invention, a small housing is provided for the blind housing, the outer dimensions of which naturally are also determined by the length of the coarse-screen or material blind, which is to be rolled up. In this connection, the blind housing is constructed particularly advantageously with a depth and a height, which in each case correspond approximately to the height dimensions of a lamella of the roller-blind armor, by means of which a particularly pleasing appearance of the roller blind as a whole results and the blind housing, appended at the bottom, also optically represents a final "end lamella". However, height dimensions of the blind housing over a length, which lies in the range between the height dimensions of one and of two lamella, as well as a depth in the range between the height dimensions of one and of three lamellae, are also usable quite advantageously in practical applications.

For the roller blinds of the invention, it is furthermore particularly advantageous if the locking mechanism for fixing the blind housing in its lowest position (that is, the closed position of the roller blind) has one or several locking pins, the ends of which protrude in the locking position into appropriate locking accommodation holes in the blind housing. Such locking pins can be mounted readily, for example, in the window frame of the associated window and operated from inside the room, so that, when the roller blind has reached the desired position, they can be guided by the operator concerned from inside the room through the window frame into the corresponding accommodating holes of the blind housing. In a particularly advantageous refinement, the locking pin is constructed as a spring pin, which can be operated by a cable, such an arrangement conferring a further, appreciable operational convenience. The locking pins may also advantageously be constructed as spring-loaded catches, it being possible to mount such spring-loaded catches in the blind housing as well as in the window frame of the associated window, the locking accommodation holes in each case being on the other of the two elements. If the spring-loaded catches are mounted on the roller blind itself, they can be used there in such a manner, that they snap in either from the side or from below.

If the roller blind of the invention is used, for example, with a material blind strictly as protection against the sun or as a means of darkening, then this can be accomplished readily with the lateral guiding rails previously in use, which are intended for the roller blinds. On the other hand, if the roller blind of the invention is also to have the function of providing protection against insects, it is advisable to provide an additional pad for the small material or coarse-screen blind disposed at the bottom of the last lamella, to ensure that over-lapping is attained between guiding rails and the material or coarse-screen blind and thus entry of insects at the sides is also effectively prevented. If, for example, the lateral guiding rails of the roller blind of the invention each are constructed U-shaped with two guide legs joined by a connecting cross member, it is particularly advisable for the purpose indicated if the material or coarse-screen blind is provided along each of its side edges with a profile, which overlaps in U-shaped fashion one of the guide legs of the associated lateral guiding rail. By these means, the desired overlapping against unwanted penetration from the sides by insects is also ensured along the sides of the coarse-screen blind. In a different preferred refinement of the roller blinds of the invention, brush or rubber sealing strips may be provided for this purpose over the height of the lateral guiding rails. These brush or sealing strips are used for making contact with the two lateral end regions of the material or coarse-screen blind which are pulled out of the blind housing. Such brush or rubber seals have proven to be particularly effective for sealing the blinds at the sides.

A further, particularly preferred and simple refinement of the roller blind of the invention for effectively preventing unwanted penetration by insects from the sides consists therein that the lateral guiding rails are provided over their height with joining strips for the lateral end regions of the material or coarse-screen blind, these joining strips projecting in the direction of the interior of the window or the door and thus in a direction towards one another and accordingly covering the pulled-out blind in the corresponding end regions from the rear, so that the blind is supported against these joining strips.

A particular simple and preferred refinement of the roller blind of the invention also consists therein that the roller of the material or coarse-screen blind in the small blind housing at the bottom of the last lamella of the roller blind armor is constructed in the form of a spring-loaded roller, preferably of aluminum. Such spring-loaded rollers are already used in conventional insect blinds, are commercially available and enable the roller blind of the invention to be constructed particularly economically.

To attach the free end of the material or coarse-screen blind to the last lamella of the armor, it is particularly advantageous to provide a suspension strip, to which the free end of the material or coarse-screen blind is attached in a suitable manner and which is attached in turn positively to the last lamella of the roller-blind armor.

When using the roller blind of the invention, the possibility is given for the case that the blind housing can be locked from inside the room of deploying the material or coarse-screen blind into any desired position by pulling up the lamella of the roller blind even without opening the window or the door. If, when using the roller blind of the invention, the material or coarse-screen guide is not to be utilized, then this material or coarse-screen blind, then this material or coarse-screen blind can easily be moved up and down together with the roller-blind armor without exerting its own function and thus caused to lie against the underside of the armor, as already mentioned, by the spring-loaded roller. No great expense is required to manufacture the inventive roller blind. This roller blind can be manufactured simply and economically and so that it will function reliably to a high degree. It is no longer necessary to connect in series or couple two individual elements, which can be pulled out (the roller blind on the one hand and the material or coarse-screen blind on the other). The blinds can also be manipulated without difficulty from inside the room and even the installation can be carried out quite easily. This basic concept of the invention employed for the inventive roller blinds, namely to dispose a material or coarse-screen blind at the bottom of the last lamella of the roller-blind armor with independent capability to lock the blind housing, can even be realized without difficulty subsequently with already existing roller blinds. With very little effort after all, it is possible to dispose such a blind housing with a material or coarse-screen blind, which can be pulled out, subsequently at the last lamella of a roller blind and to subsequently install a device for locking this housing in position, especially also from inside the room, by means of which then the inventive roller blind arrangement as a whole is subsequently achieved.

BRIEF DESCRIPTION OF THE DRAWINGS

The invention is described in greater detail in principle and by way of example in the following:

FIG. 5 shows a lateral, sectional representation in outline of the roller blind of FIG. 3, however now with the material or coarse-screen blind pulled out partly.

FIG. 6 shows a front view of the roller blind position of FIG. 5.

FIGS. 7, 8 and 9 show detailed representations in outline of three examples of locking mechanisms for the blind housing of the material or coarse-screen blind of an inventive roller blind.

DETAILED DESCRIPTION OF THE DRAWINGS

Figure 1:
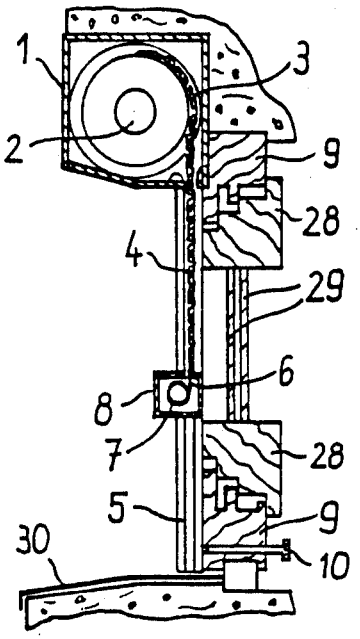
FIG. 1 shows a lateral, sectional representation in outline, in which the roller blind with the material or coarse-screen blind disposed at the bottom is let down about halfway.
Figure 3:
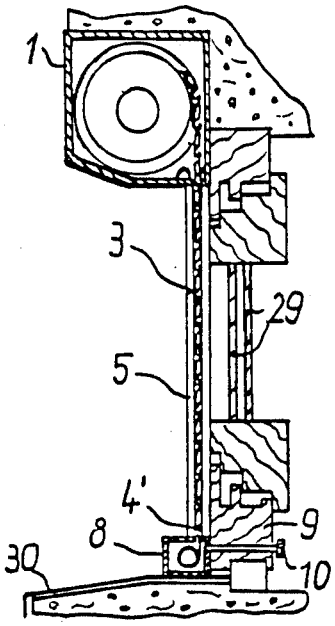
FIG. 3 shows a lateral, sectional representation in outline of the roller blind of FIG. 1, in which the roller blind, however, is let down all the way.
Figure 2:
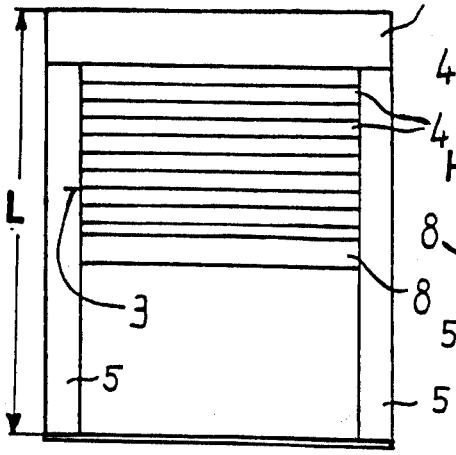
FIG. 2 shows a front view of the roller blind of FIG. 1 in outline.
Figure 4:
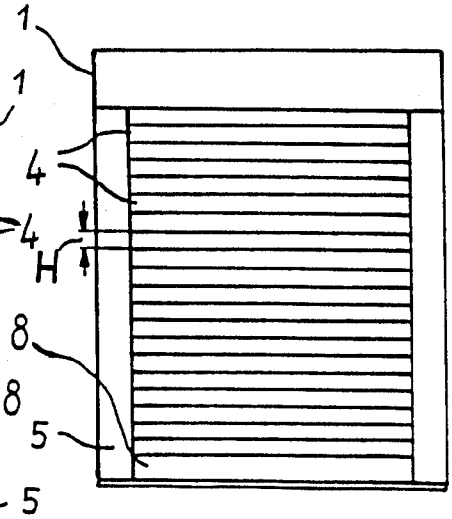
FIG. 4 shows a front view of the roller blind position of FIG. 3 (in outline).

In FIGS. 1, 3 and 5, lateral, partial sectional representations in outline of an inventive roller blind are shown, which is in three different positions in the three Figures: in FIG. 1, the roller blind is let down approximately halfway, FIG. 3 shows it in the completely letdown state and in FIG. 5, as will still be described, the roller blind is pulled up again about halfway, the material or coarse-screen blind attached to the bottom of the roller blind being pulled out partway. FIGS. 2, 4 and 6 show corresponding front views of the roller blind positions of FIGS. 1, 3 and 5 respectively.

The roller blind, shown in FIGS. 1 to 6, has an overhead roller-blind housing 1, in which a take-up roll 2 is disposed, on which the armor 3 of the roller blind can be rolled up or unrolled. Moreover, the take-up roll 2 and the armor 3 are shown only in principle, the details of the rolling-up of the armor 3 on the roll 2 not being shown.

FIG. 2 shows a diagrammatic front view of the roller blind shown in FIG. 1.

FIGS. 1 and 2 show that the roller-blind armor 3 comprises individual lamellae 4, the lowest, last lamella, (and thus the lamella at the free end of the roller blind) being labelled lamella 4'. At the last lamella 4', a material or coarse-screen blind 6 (to be selected depending on the particular application desired) is disposed, which is rolled up on a spring-loaded shaft 7 in a small blind housing 8. The spring-loaded shaft 7 moreover rolls up the material or coarse-screen blind 6 as far as possible under the spring tension of the blind 6, by which means the blind housing 8 of the material or coarse-screen blind 6 is pressed against the underside of the roller-blind armor 3.

The free end of the material or coarse-screen blind 6 is fastened in a suitable manner to the suspension strip 27 (see FIGS. 5 and 6) which, in turn, are constructed in the form of a special profile and connected positively with the last lamella 4'. This can be accomplished by providing the upper side of this suspension strip 27, which is to be connected with the last lamella 4', with a profile, which is the same or at least similar in shape to the upper side of the individual lamellae, so that it can be pushed simply, in the same manner as the lamellae among one another, on the underside of the last lamella 4', from the side for example, and thus be attached positively to this. The appropriate expert knows a plurality of possible positive fixing devices, so that he can readily find a suitable shape at any time for such a suspension strip 27, which may even do justice to additional, other, special use requirements, so that a further description of a suitable positive connection can be omitted here.

The position of the roller blind, shown in FIG. 1, can be seen particularly graphically in FIG. 2. The armor 3 is lowered about halfway over the window area to be covered, the blind housing 8, hanging at the bottom and being pressed from below against the last lamella 4' by the action of the spring-loaded shaft and strictly optically, looking like a final lamella of the entire armor 4.

The roller blinds, shown in FIGS. 1 and 2, are intended to be fixed to a window, of which only the window frame 9 and the casement 28, in which there is a windowpane 29, is shown in principle in cross section. It can furthermore be seen from FIG. 2 that, on the side of the roller blind, lateral guiding rails 5, in which the lateral ends of the armor 3 or of the lamellae 4 are guided when the roller blind is raised or lowered, run from the roller blind housing 1 at the top all the way to the bottom.

FIG. 3 shows the roller blind of FIG. 1, here, however, the roller-blind armor 3 being let down completely (see also FIG. 4) and, at the same time, the blind housing 8 for the material or coarse-screen blind 6 lying at the bottom on a window sill 30. By means of a locking pin 10, which is inserted from inside the room through the window frame 9 into an appropriate insertion opening 11 (see FIG. 7) in the blind housing 8, the blind housing 8 is locked in this lowest position. FIG. 4 once again shows the position of the roller blind of FIG. 3 in plan view from the front, and it can be seen that the roller blind here has been let down over the whole of its deployment length L (see FIG. 2). After the locking pin 10, which in FIG. 1 does not yet protrude forwards beyond the window frame 9, after the blind housing 8 reaches its lowest position, is pushed into this blind housing 8, the armor 3 is subsequently pulled upwards again by the operator, as shown in FIGS. 5 and 6. In the drawings of FIGS. 5 and 6, the armor 3 is pulled up again barely to half the height of the window opening. Due to the fact that the blind housing 8 is locked in its lowest position (see FIG. 3 and also FIG. 7), it can no longer follow the upwards motion of the armor 3 that is being pulled up by the operator, so that the material or coarse-screen blind 6, which is rolled up inside it and attached to the suspension strip 27 at the last lamella 4' of the armor, is pulled out of the blind housing 8 correspondingly against the spring action of the spring-loaded shaft 7 as the armor 3 is pulled up. If the operator once again pulls the armor 3 upwards over the whole of its deployment length L, then the material or coarse-screen blind 6 is guided upwards over the whole height of the window, so that there is then a window opening, which is covered from the direction of its outside exclusively by the material or coarse-screen blind 6. If now, at a later time, the material or coarse-screen blind 6 is also to be removed once again (while the armor 3 is still pulled up), the locking pins 10 must be retracted once again into the window frame 9 and, by so doing, the blind housing 8 is unlocked from its position, whereupon, under the action of the spring-loaded shaft 7, the material blind 6 rolls up in the blind housing 8 and, at the same time, moves upwards until it comes to rest against against the bottom of lamella 4' of the armor 3.

As insect-protection fabric for blind 6, a fiber-glass fabric, possibly also coated with PVC, can be used: of course, other coarse-screen or material fabrics can also be used as required.

As can readily be seen from FIGS. 1 to 6 and especially from FIGS. 2 and 4, the blind housing 8 is not much higher than the height H of a single lamella 4 of the armor 3 (see FIG. 2). In many cases, it will be possible to construct the blind housing so as to have a height, which corresponds exactly to the that of such lamella so that a special uniformity of the optical picture from the outside is ensured even when the armor is let down. As a rule, it will at least be possible to keep the height of the blind housing 8 in a range, which is between once and twice the height of a single lamella (H to 2H) (see FIG. 4).

FIGS. 7 to 9 are schematic, detailed sectional representations of various possibilities for locking the blind housing 8 in its lowest position.

For the possibilities shown in FIG. 7, a pin 10, as already shown in FIGS. 1, 3 and 5, is inserted through the window frame 9 of the window into an appropriate locking or accommodating hole 11 in the blind housing 8. Preferably, two such locking pins 10 are provided over the length of the blind housing 8, these pins 10, in turn, being preferably disposed symmetrically to the longitudinal center line of the roller-blind armor. The representation of FIG. 7 shows, in principle, the coarse-screen or material blind 6, running out of the blind housing 8, as well as the spring-loaded shaft 7 which, by means of a volute buffer spring 12 which is shown only in principle, keeps the blind 6 under spring tension.

For the possible locking mechanism of the blind housing 8 shown in FIG. 8, a locking pin 10' is once again used, which however, over a radial supporting collar 13 disposed on it, is pretensioned by means of a compression spring 14 in the direction of a locking position deployed from the window frame 9. The locking pin 10' is put into action by means of a cable line 15, to which a deflection pulley 16 is assigned in the representation of FIG. 8; this is only intended to show basically that, by means of a suitable deflection pulley or the like, the cable line 15 can be conducted to a place, where it is particularly accessible to the operator. If the tension on the cable line 15 is released, the locking pin 10' is guided by the action of the compression spring 14 into the accommodating hole 11 in the blind housing 8 of the coarse-screen or material blind 6; such a locking position is shown in principle in FIG. 8.

In the embodiment represented by FIG. 9, a spring-loaded catch 17 is used, which is disposed in the blind housing 8 and is constantly pretensioned under the action of a spring 18 in the direction of an extended position. As soon as the blind housing 8 reaches a position, in which the spring-loaded catch 17 is opposite a corresponding accommodating hole in the window frame 9, the spring-loaded catch immediately snaps into this, so that an (automatic) locking system for the blind housing is given at once. However, an opportunity must then be provided (which is not shown in FIG. 9) to return the spring-loaded catch to its retracted position, when the blind housing 8 is to be unlocked once again. This can be accomplished, for example, by small sliding pins, which are disposed in an accommodating hole drilled in the window frame 9 in alignment with the center line of the spring-loaded catch 17 and are sufficiently long so that, when the spring-loaded catch is engaged, they protrude by an appropriate length out of the window frame on the inside of the window. If they are now pushed in once again there by the appropriate length by the operator, then this means that the spring-loaded catch is pushed once again against the action of the compression spring 18 out of the accommodating hole in the window frame 9 and can be pulled up. If the blind housing 8 is then pulled up, the compressive action of the spring-loaded catch 17 falls to the share of such a sliding pin, as a result of which the sliding pin remains unstressed in its accommodating hole and is pushed out of this again by an appropriate amount only when the blind housing 8 reaches its locking position and the spring-loaded catch 17 snaps in once again. Of course, there is a plurality of other possibilities that will let such spring-loaded catches lock automatically, but then be unlocked again manually or otherwise when required. Since these possibilities are familiar to those skilled in the art, it is unnecessary to go into them in any greater detail here.

FIGS. 10 to 14 show some additional possible constructions of a seal for the sides of the coarse-screen or material blind 6 for the case that it is to be used as protection against insects. These constructions are intended to prevent insects entering in an unwanted manner through the window opening past the side edges of the blind 6. The representations of FIGS. 10 to 14 are kept quite basic and represent outline cross sections through the lateral guide strips 5 and the side region of the coarse-screen or material blind 6, the sectional plane running perpendicularly to the direction of motion of the roller-blind armor 3.

Figure 10:
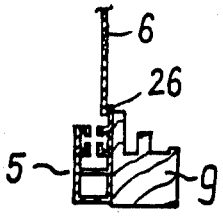
FIGS. 10, 11, 12, 13 and 14 show detailed sectional drawings in outline of various examples of the construction of the lateral development or seal of the material of coarse-screen blind for use as protection against insects.

In the representation of FIG. 10, the lateral region of the blind 6 is covered by an appropriate joining strip 26, which comprises a lateral elongation of the inner leg of the lateral guiding profile 5. By these means, contact or so narrow an opening gap is created in the overlapping region between the coarse-screen or material blind 6 and the contacting strips 26, which are disposed on both lateral guiding strips 5 and project in the direction towards one another, that penetration at the sides by insects is prevented.

Figure 11:
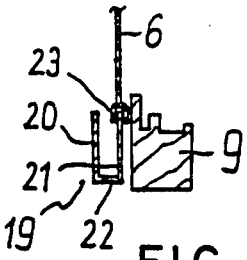

A different solution is shown in FIG. 11, where U-shaped lateral edge profiles 23 are disposed along the side edges of the blind 6. These overlap in U-shape fashion a lateral guiding leg 21 of the lateral guiding rail 19, which is also constructed here with a U-shaped cross section and which, in cross section, has two side legs 20 and 21 a cross member 22 connecting these on one side. This lateral, U-shaped overlapping profile 23 on the blind 6 can moreover consist either directly of the fabric material of the blind 6 and be manufactured in one piece with this or may consist of appropriate profiles 23 of other suitable materials (possibly even of rubber or the like) mounted or attached on the otherwise straight side edges of the blind 6.

Figure 12:
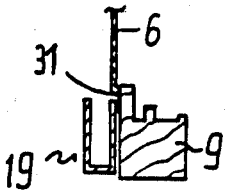

In the embodiment shown in FIG. 12, a small, only slightly wider shoulder 31 is mounted on the side of the coarse-screen or material blind 6. As the blind 6 moves, this shoulder 31 runs between innermost lateral cross member 21 of the corresponding lateral guiding rail 19 and the window frame 9 or is even jammed a little there.

Figure 13:
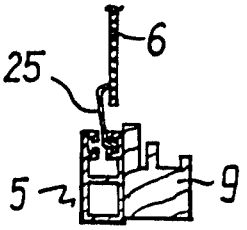
Figure 14:
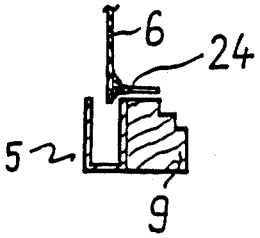

In the representations of FIGS. 13 and 14, special sealing elements are used at the side for the blind 6. In the embodiment of FIG. 13, the lateral guiding rail 5 is provided with a special rubber sealing profile 25 ("rubber weatherstrip"), while for the embodiment of FIG. 14 appropriate brush seals ("brush sealing strips") are used at the sides. The brush seal 24 lies with its brush against the side region of the pulled-out blind 6 and provides there an appropriate insect seal. In the case of the rubber weatherstrip 25 of the version of FIG. 13, a special sealing lip is provided which likewise provides the lateral sealing effect.

Figure 15:
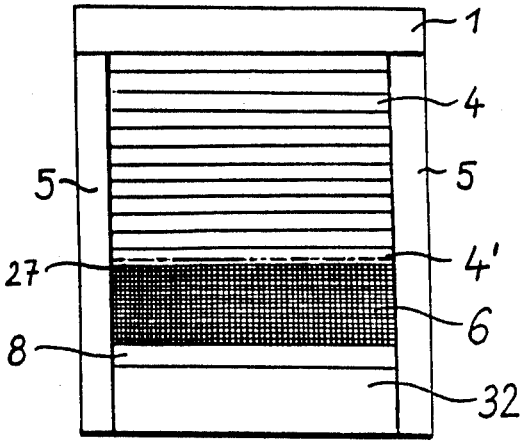
FIG. 15 shows the front view of the inventive roller blind of FIG. 1, in which the lowest part of the window opening is free and the blind housing for the material or coarse-screen blind is locked only above this lowest part.

FIG. 15 finally shows the roller blind of FIGS. 1 to 6 in an intermediate position. The blind housing 8 is stopped here at a particular height on the guiding rails 5, so that a partial area 32 of the window, which is not covered either by the roller blind armor or by the blind 6, is completely free and open below the blind housing 8. Only above the same does a second partial area extent, which is covered by the blind (perhaps to dim the sunlight). Adjoining this, the rest of the window opening is closed off by the lamellae 4 of the roller-blind armor.

Beyond the embodiments of the inventive roller blinds shown in the Figures, there is a plurality of further possible modifications of the locking devices as well as of the lateral seals of the blind, all of which however can be discovered and used without difficulties by an expert.

I claim:

1. Roller blind having two sections a first of which comprises an adjustable length armor having a series of lamellae, may be moved in guiding rails (5) at the side over a deployment length and which can be rolled on or off a take-up roll (2) disposed in a roller-blind housing (1), the free end of a material or coarse-screen (7) that in turn is accommodated in a blind housing (8), being fastened to the last lamella (4') at the free end of the armor (3) and the blind housing (8) being disposed below the last lamella (4') of the armor (3), wherein the blind housing (8) can be moved over the deployment length (L) of the armor (3), can be locked in position at any height within the deployment length (L) by means of a locking mechanism (10, 11) and, when not in the locked position, is pressed by the tension of a spring in set contact with the last lamella (4') of the armor (3) said armor being adapted for movement in lateral, spaced apart, guide rails over a deployment length, a first roller-blind housing spanning one end of said lateral guide rails, a first take-up roll disposed in said housing in a position enabling rolling of said lamellae on or off said first roll for shortening or increasing the length of said armor, a second section of said roller blind comprising a continuous blind section normally rolled up under spring tension on a second roll accommodated in a second housing and having a free end fastened to a free end of that lamella most distant from said first housing, said second housing, by virtue of rolling up of said second section on said second roll under spring tension being disposed below said most distant lamella of said armor for movement with said armor over its deployment length, and means for locking said second housing against movement with said armor enabling rolling of said second section off said second roll during rolling of said lamellae on said first roll.

2. Roller blind as defined in claim 1, wherein the blind housing as well as the lamellae for the armor are guided in the lateral guide rails.

3. Roller blind as defined in claim 1, wherein the dimension of the second housing essentially corresponds to the height of a lamella.

4. Roller blind as defined in claim 1, wherein said locking means is effective to lock said second housing against movement with said armor when the armor is fully deployed and comprising at least one locking pin extending into said second housing.

5. Roller blind as defined in claim 4, wherein the at least one locking pin is a cable-operated spring pin.

6. Roller blind as defined in claim 4, wherein the locking pin is a spring-loaded catch.

7. Roller blind as defined in claim 1, wherein the lateral guide rails are U-shaped, said second section of said roller blind comprising a coarse screen or a material inhibiting light and/or insect passage and having along its side edges a profile to overlap a leg of the U-shaped guide rails nearest a window to which the roller blind is to be fixed.

8. Roller blind as defined in claim 1, wherein sealing strips are provided at the guide rails for contact with lateral end regions of said second blind section.

9. Roller blind as defined in claim 1, wherein said guide rails are provided with contact strips which engage lateral end regions of said second blind section.

10. Roller blind as defined in claim 1, wherein the second roll comprises a spring-loaded roller.

11. Roller blind as defined in claim 1, wherein the free end of said continuous blind section is connected positively with the last lamella of the armor over a suspension strip positively attached to it.

12. A two section roller blind, a first section of which comprises a first blind section windable on and unwindable from a first roller provided in a fixed first housing, said first blind section being deployable a predetermined distance from said first roller, a second blind section operatively connected at one of its ends to a lower end of the first blind section, spring means normally effective to wind an opposite end of said second blind section onto a second roller in a second housing, which second housing, by virtue of the winding action on said second blind section by said spring means and said operative connection of said second blind section to said lower end of the first blind section, follows, unless restrained, movement of said first blind section during deployment thereof said predetermined distance, and restraining means operative to restrain the second housing against movement with the first blind section and resulting thereby in unwinding of the second blind section from said second roller during winding action of said first blind section on said first roller.

13. The roller blind of claim 12, wherein said restraining means is operated to restrain said second housing in the fully deployed condition of said first blind section.

* * * * *